US006997815B2

(12) United States Patent
Devine

(10) Patent No.: US 6,997,815 B2
(45) Date of Patent: Feb. 14, 2006

(54) SWING FOR HANDICAPPED PERSONS

(75) Inventor: Wayne Devine, Mortdale (AU)

(73) Assignee: Jenway Industries PTY Limited, Mortdale (AU)

( * ) Notice: Subject to any disclaimer, the term of this patent is extended or adjusted under 35 U.S.C. 154(b) by 56 days.

(21) Appl. No.: 10/678,550

(22) Filed: Oct. 2, 2003

(65) Prior Publication Data

US 2005/0101394 A1 May 12, 2005

Related U.S. Application Data

(63) Continuation of application No. 10/130,095, filed as application No. PCT/AU00/01394 on Nov. 14, 2000, now Pat. No. 6,736,732.

(30) Foreign Application Priority Data

Nov. 15, 1999 (AU) ..... PQ 4038
Jul. 13, 2000 (AU) ..... PQ 8774

(51) Int. Cl.
*A63G 9/00* (2006.01)

(52) U.S. Cl. ..... 472/118; 472/125

(58) Field of Classification Search ..... 472/118–125, 472/57, 59; 14/69.5, 71.1; 414/462, 537, 414/921
See application file for complete search history.

(56) References Cited

U.S. PATENT DOCUMENTS 4,103,934 A 8/1978 Arnholt et al.
4,620,702 A 11/1986 Hemmeter
4,828,250 A 5/1989 Reiche
5,161,522 A 11/1992 Clevenger
5,884,563 A 3/1999 Sheldon et al.
5,935,011 A 8/1999 Morgan et al.
5,938,283 A 8/1999 Babcock et al.
6,074,306 A 6/2000 Behringer
6,149,528 A 11/2000 Volz et al.
6,171,198 B1 1/2001 Lizama Troncoso et al.

FOREIGN PATENT DOCUMENTS

DE 296 14 136 10/1996
DE 296 20 558 1/1997
DE 296 20 558 3/1997
GB 2 195 259 4/1988

*Primary Examiner*—Kien Nguyen
(74) *Attorney, Agent, or Firm*—Smith-Hill and Bedell

(57) ABSTRACT

The present invention relates to playground apparatus, and in particular to a swing apparatus which may be used by a person confined to a wheelchair.

The preferred embodiment of the swing apparatus includes a main body which is adapted to accommodate a wheelchair. The body is formed from moulded plastic and is suspended from a frame structure for reciprocating motion by means of two pairs of substantially parallel arms. The body includes vertically extending internal frame members within the side walls of the body and transversely extending frame members underneath the body connecting opposing vertical frame members located on each side of the swing body. The body of the swing further includes a seat assembly which can be moved between a collapsed position and a raised position. The seat assembly comprises a pair of members which are adapted to clip together so as to provide a secure engagement when the seat is in its erected position. If the swing is to be used by a person in a wheelchair the seat assembly is collapsed so as to allow the wheelchair to be accommodated within the body.

15 Claims, 7 Drawing Sheets

SWING FOR HANDICAPPED PERSONS

CROSS-REFERENCE TO RELATED APPLICATION

This application is a continuation of U.S. patent application Ser. No. 10/130,095 filed May 13, 2002 (now U.S. Pat. No. 6,736,732) which was filed as entry into the national stage of PCT/AU00/01394 filed Nov. 14, 2000.

FIELD OF THE INVENTION

The present invention relates to playground apparatus, and in particular to a swing apparatus which may be used by a person confined to a wheelchair.

BACKGROUND OF THE INVENTION

In recent years, there has been an increasing awareness of the needs of physically and/or mentally handicapped persons. For example, whereas in the past there has been segregation of able-bodied and disabled children in schools, recently there has been a move towards integrating handicapped persons into the general community. Schools designated "special" have been established to permit both disabled and able-bodied children to coexist in an environment that is beneficial to both groups. Disabled children experience an environment that is similar to that which they will experience outside of school. Able-bodied children are given a chance to mingle with the physically disabled and become familiar with and understand various disabilities and the associated problems with which the disabled must contend.

Whilst there are many playgrounds available for use by able-bodied people, little consideration appears to have been given to the provision of playground facilities for persons confined to a wheelchair. Most playground equipment is made for able-bodied people and, in spite of the desire of disabled people to participate in playground activities, they are generally not able to do so due to a lack of suitable recreational equipment.

The present invention is directed to providing swing apparatus which may be used by a person confined to a wheelchair and the object of the present invention is to overcome or ameliorate at least one of the disadvantages of the prior art, or to at least provide a useful alternative.

SUMMARY OF THE INVENTION

A first aspect of the present invention provides a swing apparatus for persons confined to a wheelchair, said swing including a body adapted to accommodate a wheelchair, said body including a platform adapted to carry said wheelchair, and one or more walls extending upwardly from said platform.

A second aspect of the present invention provides a swing apparatus for persons confined to a wheelchair, said swing including a body adapted to accommodate a wheelchair, said body including a seat positionable between a first position to provide seating for a user, and a second position which allows for accommodating a wheelchair.

A third aspect of the present invention provides a swing apparatus for persons confined to a wheelchair, said swing including a body adapted to accommodate a wheelchair; a ramp so as to permit access to the body by a person confined to a wheelchair, one end of said ramp adapted to be attached to the ground, and a second end of the ramp adapted to be releasably attachable to said body so as to enable wheelchair access to said body.

A fourth aspect of the present invention provides a swing apparatus for persons confined to a wheelchair, said swing including a body adapted to accommodate a wheelchair; said body including a retaining means for securing said wheelchair in position with respect to said body, said retaining means being mounted on a movable mounting so as to facilitate positioning of said mounting with respect to said wheelchair.

BRIEF DESCRIPTION OF DRAWINGS

A preferred embodiment of the invention will now be described, by way of example only, with reference to the accompanying drawings in which.

DESCRIPTION OF PREFERRED EMBODIMENT

Figure 1:
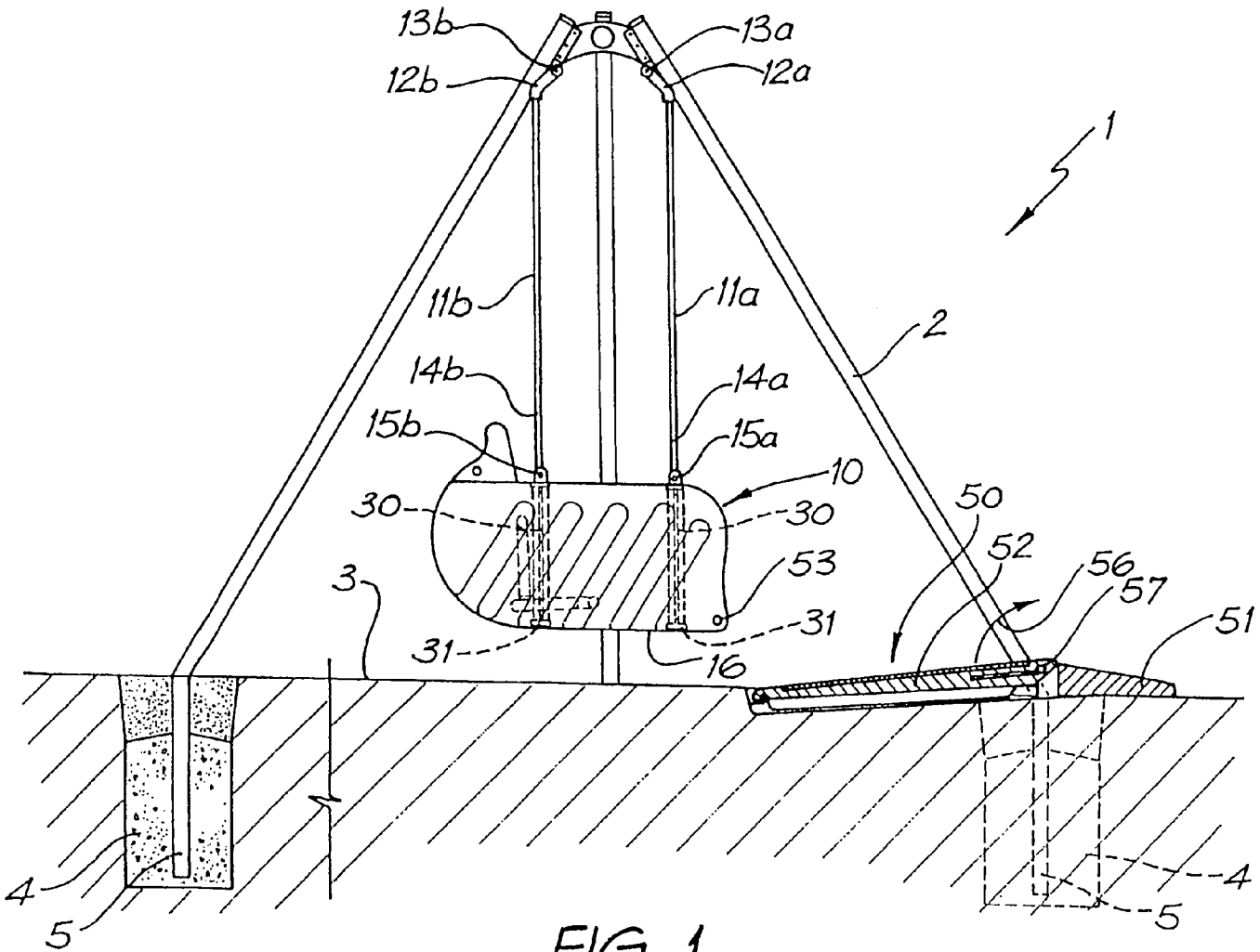
FIG. 1 depicts a side elevation of a preferred embodiment of the swing according to the present invention, with the access ramp being disconnected and the internal seat in a collapsed position.

FIG. 1 depicts a preferred embodiment of the swing apparatus 1 according to the present invention. The apparatus includes a frame structure 2 which is suitably secured to the ground 3. In the arrangement depicted, the frame structure is secured to the ground by means of concrete footings 4 into which the lower ends 5 of the frame structure are set. However it is to be appreciated that other means of securing the frame structure to ground may be employed.

In accordance with a first aspect of the present invention, the swing apparatus 1 includes a body 10 which is adapted to accommodate a wheelchair. The swing body 10 is suspended from the frame structure for reciprocating motion by means of two pairs of substantially parallel arms 11*a*, 11*b* which are pivotably mounted at their respective upper ends 12*a*, 12*b* to mounting points 13*a*, 13*b* on the upper section of the frame structure. The lower ends 14*a*, 14*b* of the arms are pivotally connected to mounting points 15*a*, 15*b* on the swing body.

FIGS. 4 to 8 depict various views of the preferred embodiment of the main body 10 of the swing apparatus. The body 10 is adapted to accommodate a wheelchair and includes a platform 17 upon which the wheelchair is carried when in use. Extending upwardly from the platform 17 are side and rear walls 18, 19 respectively. Preferably the main body of the swing is formed from moulded plastic so as to provide suitable strength whilst also minimising weight. In the preferred embodiment the body 10 is of unitary construction, with the platform, side and rear walls being integrally formed by means of moulding. Ribbing 21 may be provided in one or more walls of the body so as to enhance the rigidity of the body.

Figure 2:
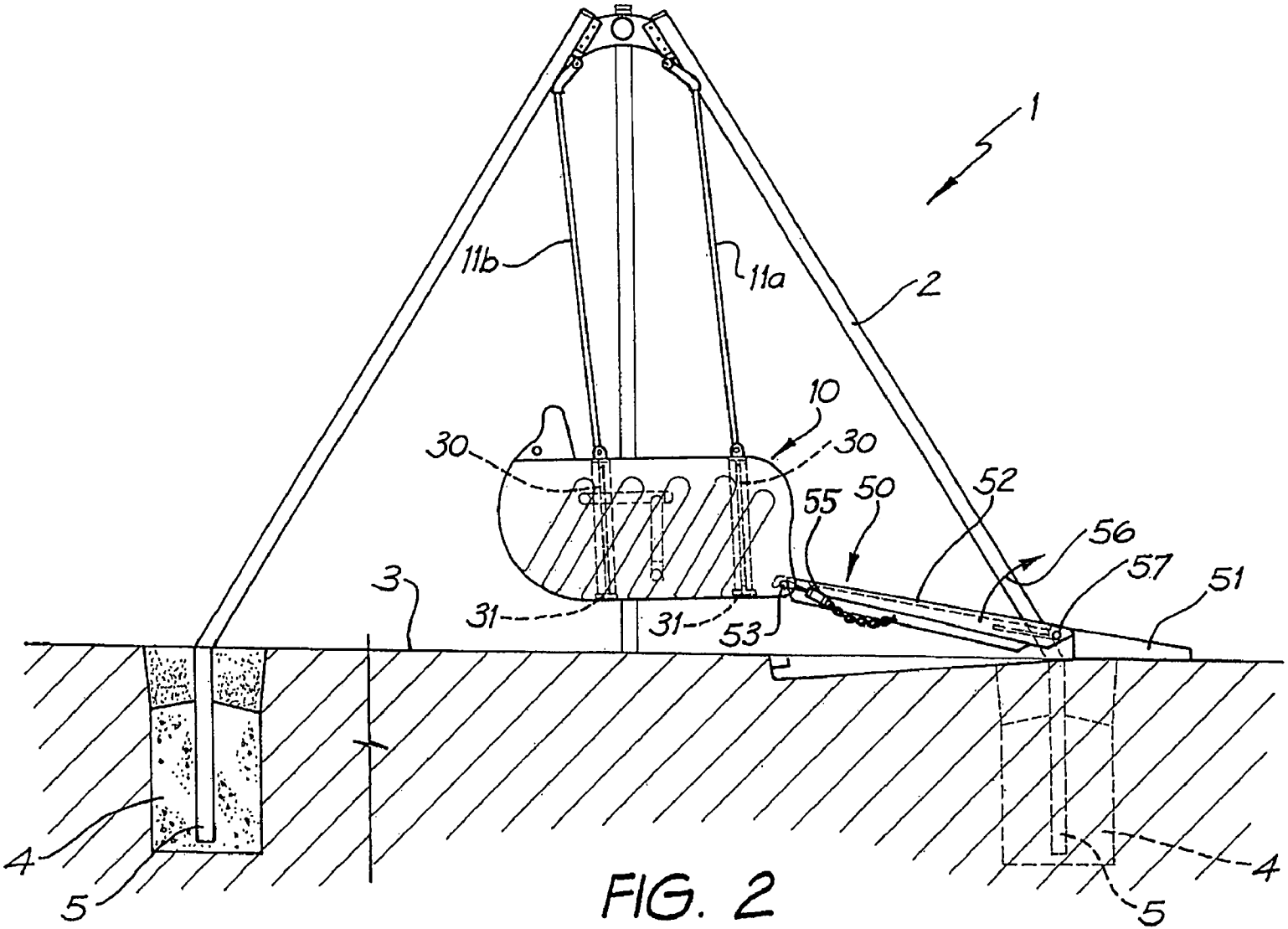
FIG. 2 depicts a side elevation of a preferred embodiment of the swing according to the present invention, with the access ramp being connected and the internal seat in an erected position.
Figure 3:
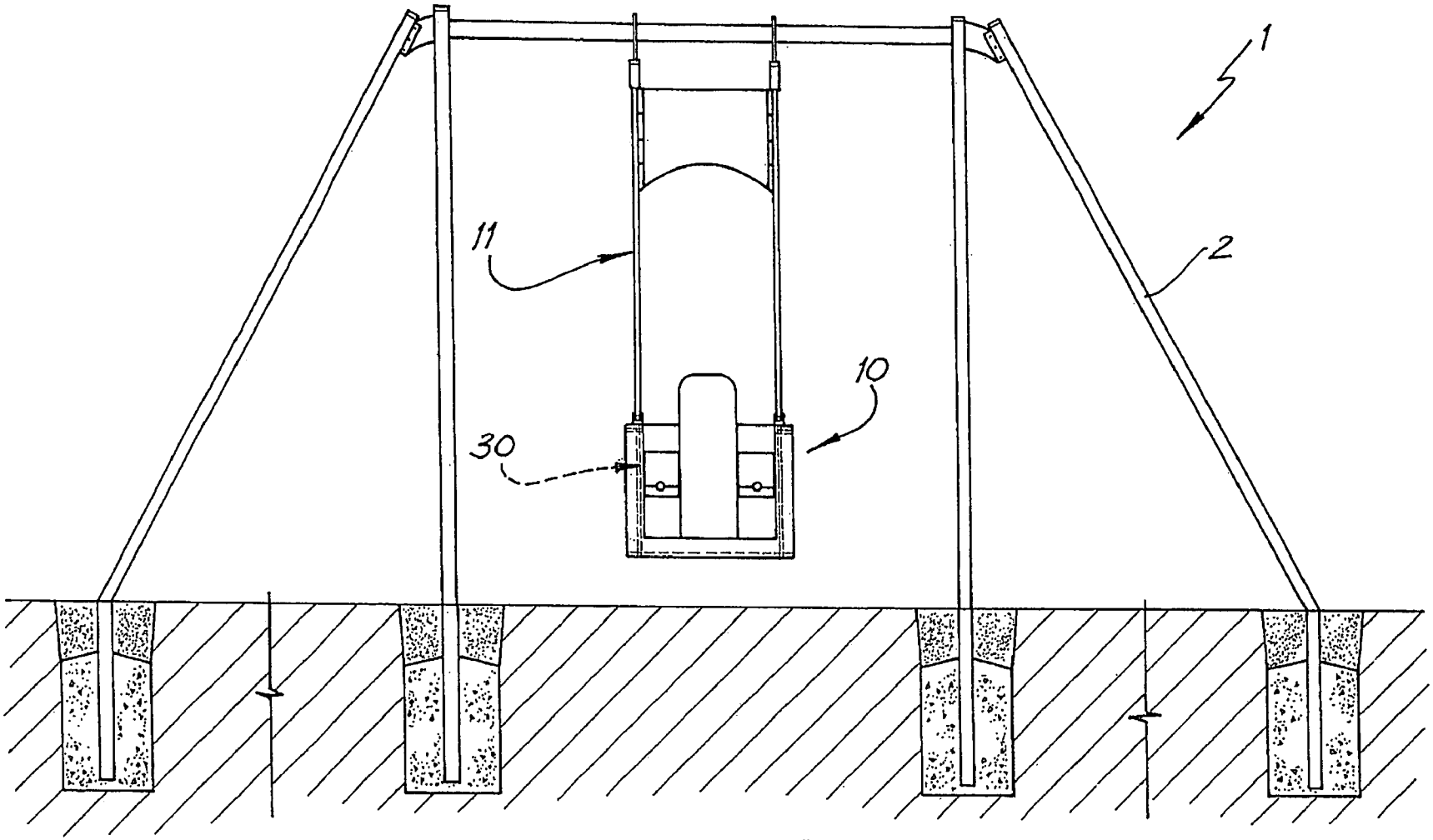
FIG. 3 depicts a rear end elevation of the swing assembly according to the preferred embodiment of the invention.

As best illustrated in FIGS. 1 and 2, the body includes vertically extending internal frame members 30 within the side walls of the body. In the preferred embodiment the internal frame members 30 take the form of steel rods. The upper ends of the members 30 are connected to the mounting points on the swing body 10. Transversely extending frame members 31 pass underneath the body and connect opposing vertical frame bracing members located on each side of the swing body. Preferably the transverse members 31 take the form of steel plates or sections. In this way, the load of the swing is carried by the internal structure of the swing body rather than the swing body itself.

Figure 4:
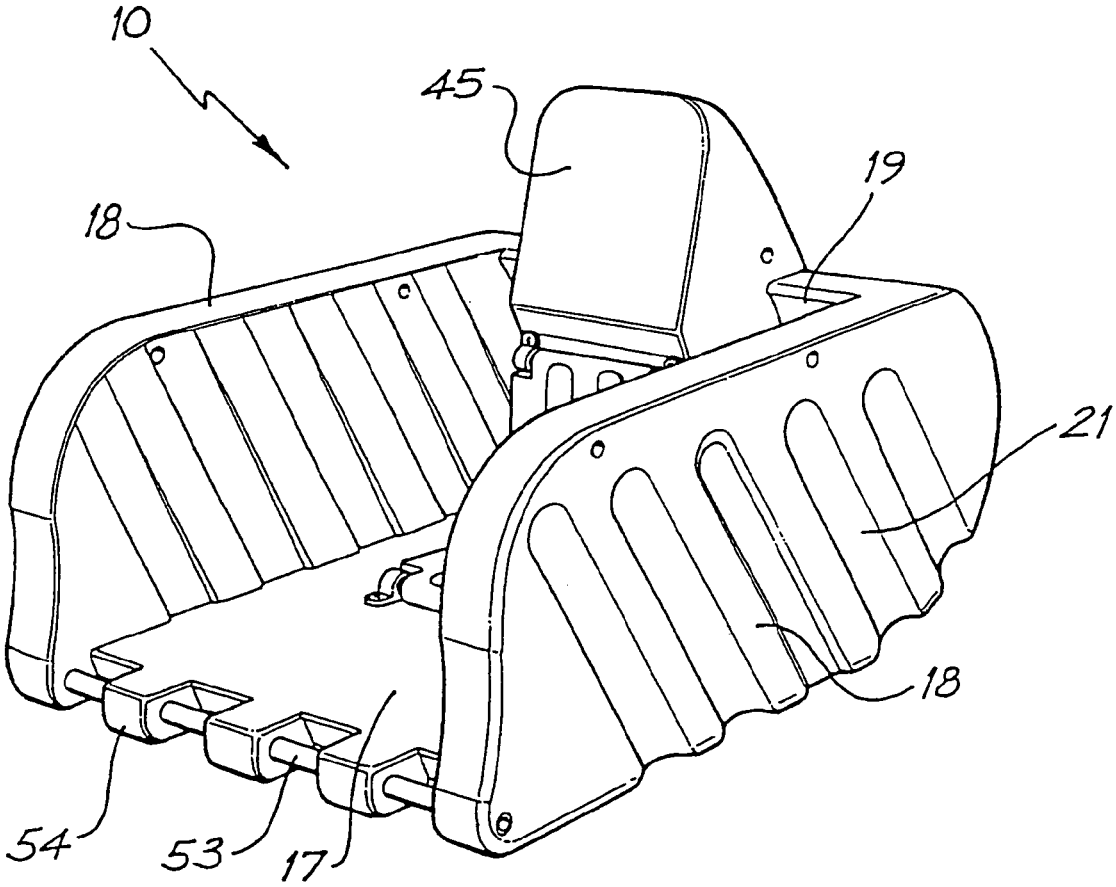
FIG. 4 depicts a perspective view of the main body of the swing, with the internal seat shown in a collapsed position.
Figure 5:
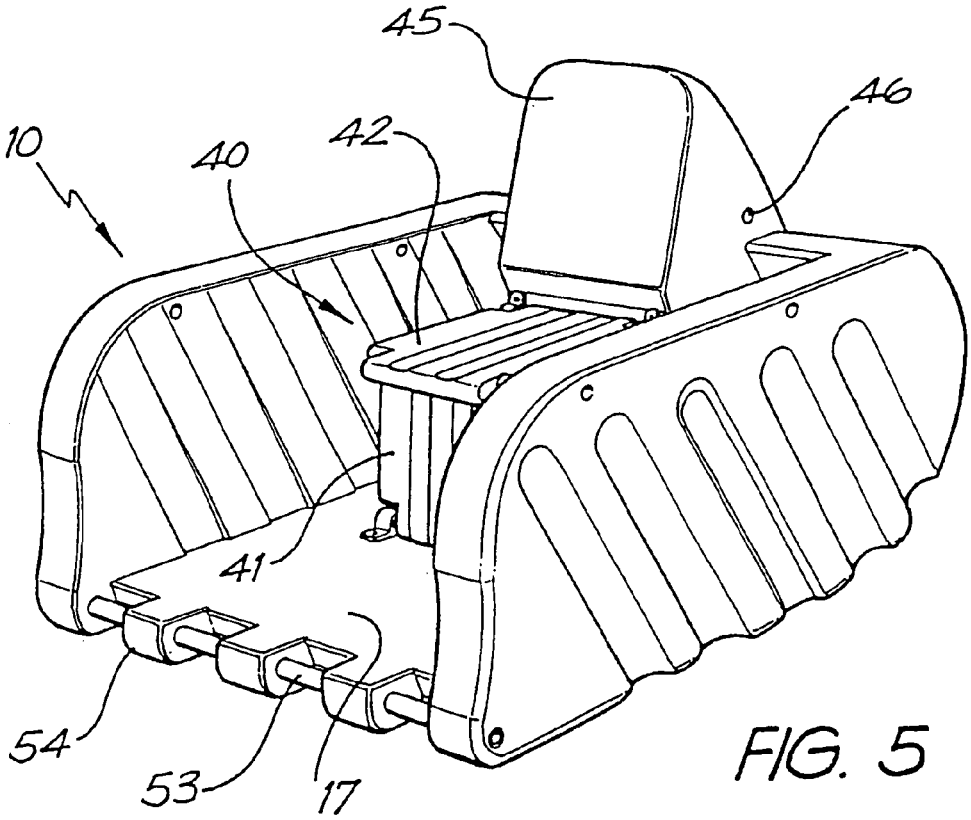
FIG. 5 depicts a perspective view of the main body of the swing, with the internal seat shown in an erected position to provide seating for the occupier.
Figure 6:
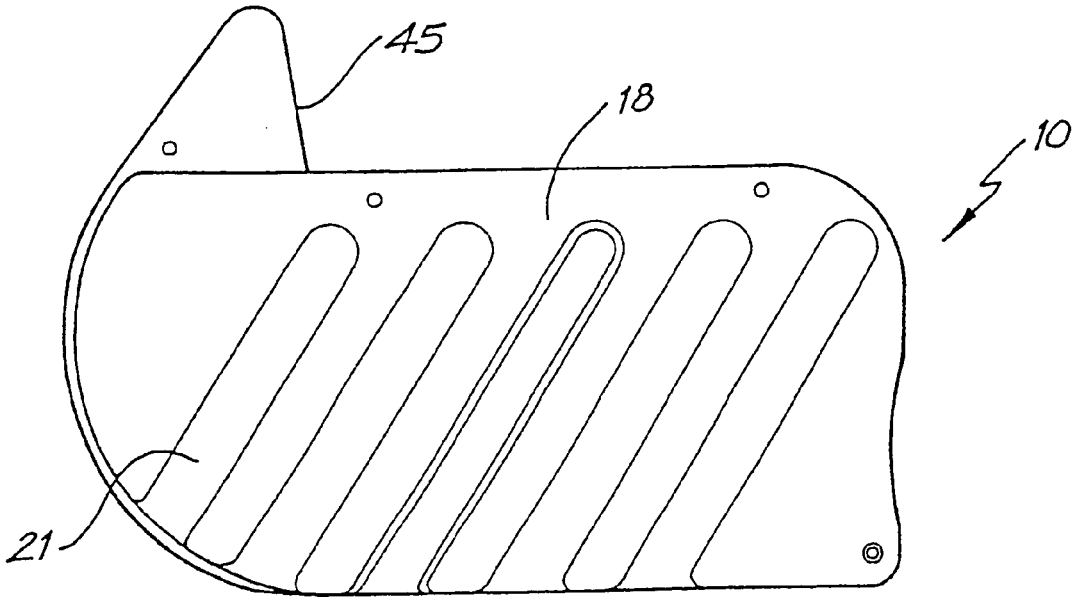
FIG. 6 depicts a side elevation of the main body of the swing.

In accordance with a second aspect of the present invention, the body of the swing includes a seat assembly 40 which can be moved between a collapsed position as shown in FIG. 1, and a raised position as shown in FIG. 2. Preferably, the seat assembly 40 includes a pair of members 41, 42, a first member 41 being pivotably mounted to the platform of the body and a second member 42 being pivotably mounted to the rear wall. Preferably, the members are adapted to clip together so as to provide a secure engagement of the two members when the seat is in its erected position. If the swing is to be used by a person in a wheelchair, the seat is collapsed as shown in FIG. 1 and FIG. 4 so as to allow the wheelchair to be accommodated within the body. The rear wall of the main body also preferably includes a generally upright surface 45 which provides a backrest for the user. Preferably, the surface 45 is integrally formed in the rear wall 19 of the main body and is formed so as to provide support to a user when seated on the seat assembly 40.

The rear wall may also be provided with anchor points 46 for the installation of a seat belt so as to provide additional safety for a user whilst the swing is in motion.

As illustrated in FIGS. 1 and 2, a third aspect of the present invention is a ramp assembly 50 for facilitating the movement of a wheelchair on and off the swing. Preferably, the ramp comprises a first ramp member 51 which is secured to the ground. The first ramp member is pivotably connected to a second ramp member 52 which is adapted to releasably engage with the body 10 of the swing. As illustrated in FIG. 2, in order to connect the ramp to the body of the swing, the body of the swing is moved forward to a position whereby the end of the ramp member can engage with a transversely extending connecting rod 53 located along the leading edge 54 of the swing body. It has been found that a ramp angle in the range of 6 to 12° to the horizontal facilitates relatively easy wheelchair access up and down the ramp.

As shown in FIG. 2, the ramp assembly 50 is preferably provided with a locking means 55 so as to lock the ramp 52 onto the body of the swing. It is envisaged that when installed in a park the ramp 52 would be locked onto the body of swing when the swing is not in use so as to provide ready wheelchair access to the swing body. Once the wheelchair is in position, the lock would be released so as to enable the ramp 52 to be detached from the body of the swing and lowered to position adjacent the ground as shown in FIG. 1.

Referring to FIGS. 1 and 2, the ramp assembly 50 is provided with a biasing means which is configured so as to provide a biasing force which acts to reduce the weight load of the ramp thereby enabling a person to lift the ramp 52 into engagement with the body of the swing more easily. More particularly, the biasing means is configured to provide a moment as indicated by the arrow 56 around the pivot point 57 of the second ramp member 52 which opposes the weight load of the ramp. In one preferred embodiment, a torsion spring is provided at the pivot point 57 to provide the moment.

Figure 7:
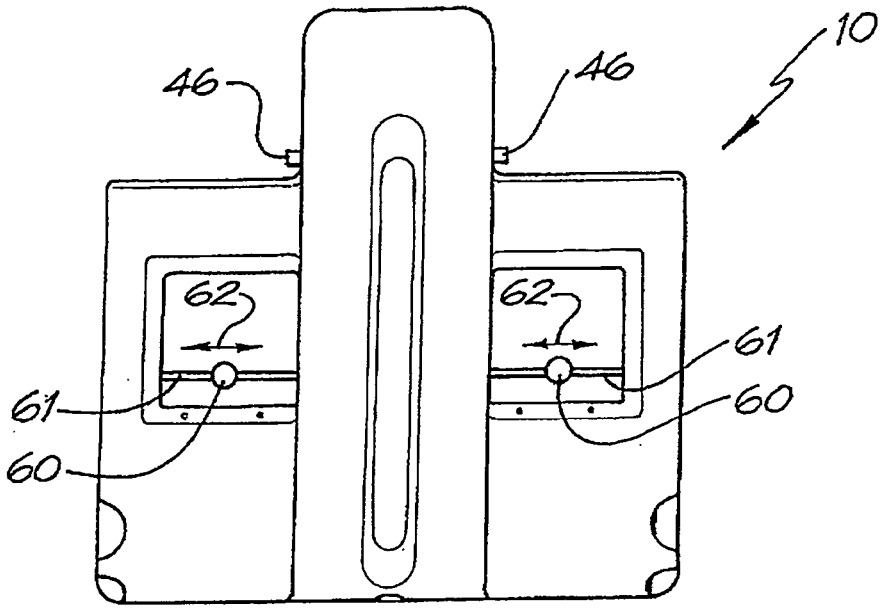
FIG. 7 depicts a rear elevation of the main body of the swing.
Figure 8:
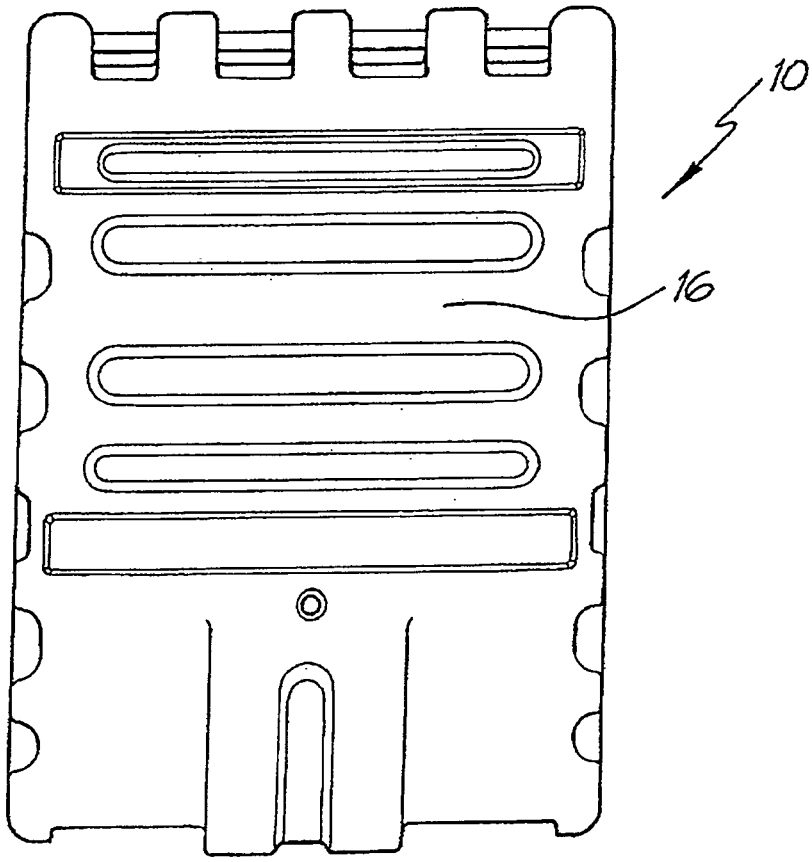
FIG. 8 depicts an inverted plan view of the main body of the swing.
Figure 9:
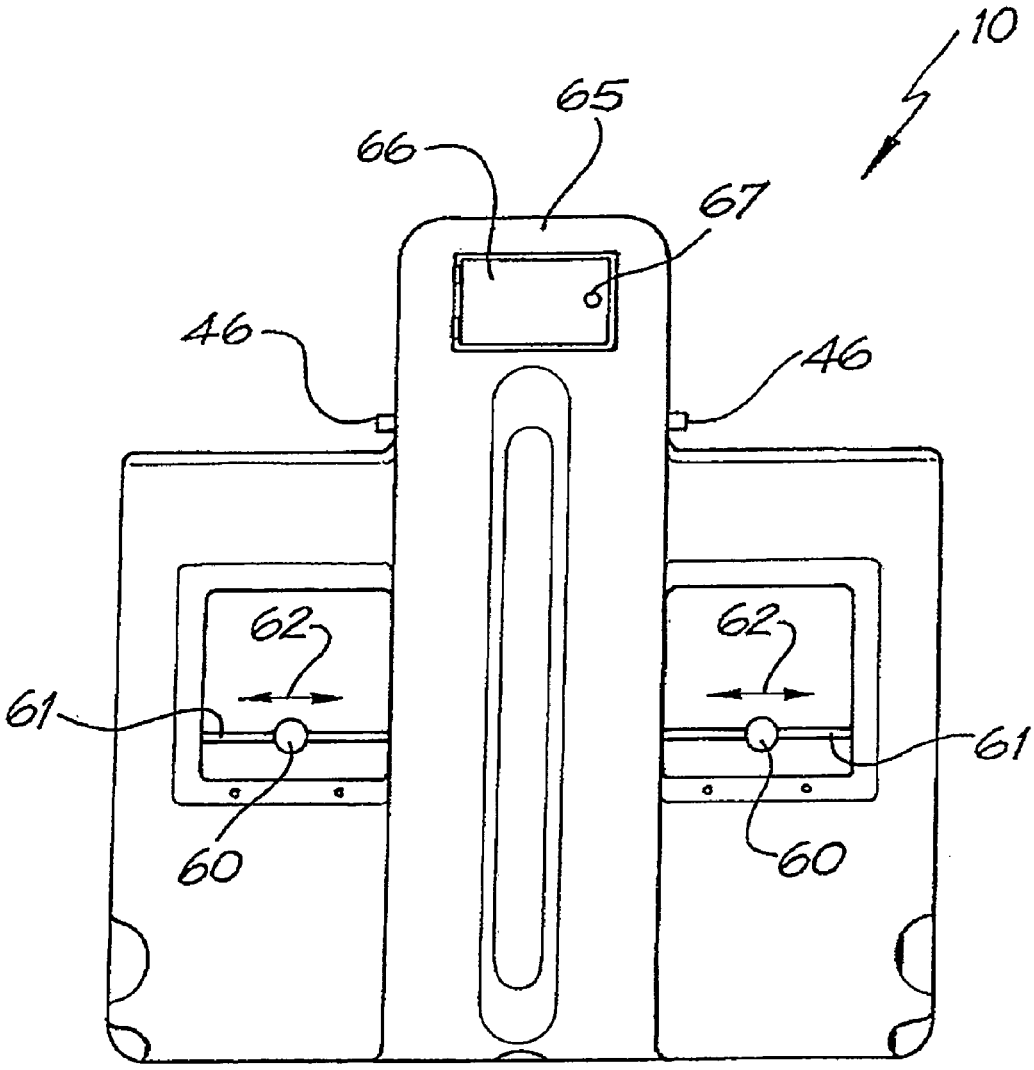
FIG. 9 depicts a rear elevation of a further embodiment of the main body of the swing incorporating a closable storage compartment.

In accordance with a fourth aspect of the invention, and as shown in FIG. 7, the body of the swing is preferably provided with mounting points 60 on its rear wall so as to provide for a means of retaining a wheelchair securely in position within the body of the swing whilst the swing is in motion. In a preferred form, the retaining means takes the form of a chain, strap, or the like which is connected to a mounting point 60 on the rear wall of the body of the swing. In use, a free end of the retaining chain or strap is passed through a wheel of the wheelchair and then connected to the rear wall and tightened sufficiently to Securely retain the wheelchair in position. In the preferred embodiment, a retaining chain, strap or the like is provided on each side of the body of the swing so as to engage with and retain each of the two rear wheels of a wheelchair. Preferably, the retaining chain is connected to the mounting 60 which is slidably mounted on a member 61 so as to permit relative lateral movement of the mounting point as shown by the arrows 62. In this way, the mounting point of the chain or strap can be positioned directly behind the wheel of the wheelchair so as to ensure that the wheelchair is securely retained in position. In use, when the wheelchair is positioned within the body of the swing, the mountings for the retaining chains are positioned directly behind the respective rear wheels of the wheelchair. One end of the retaining chain is connected to the mounting, whilst the tree end of the chain is passed through the wheel of the wheelchair and then connected to a hook, clip or the like on the mounting. The hook or clip is located on a threaded member, the axial position of which can be adjusted by turning the member in the desired direction. In this way, it is possible to tighten the retaining chain.

In a further embodiment of the present invention the main body 10 of the swing apparatus is provided with a closable storage compartment 65, preferably located in the rear wall of the swing body. The storage compartment 65 is provided with a door or cover 66 so as to close the compartment. It is further preferable that the door or cover be provided with a lock so that access to the compartment can only be obtained if a matching key is used. The storage compartment may be used to store a seat belt which may be used to provide restraint for the user whilst the swing is in motion as previously described.

Although the invention has been described with reference to specific examples it will be appreciated by those skilled in the art that the invention may be embodied in many other forms.

What is claimed is:

1. A swing apparatus for persons confined to a wheelchair, said swing including:

a body adapted to accommodate a wheelchair, said body including a seat assembly comprising a pair of seat members moveable between a first position whereby the seat members are engaged with each other to form a seat for a user, and a second position whereby the seat assembly is collapsed to accommodate a wheelchair, a ramp so as to permit access to the body by a person confined to a wheelchair, said ramp comprising a first ramp member for securing to the ground, said first ramp member being pivotably connected to a second ramp member adapted to releasably engage with the body of the swing, said swing apparatus further including a locking means so as to lock the ramp onto the body of the swing.

2. A swing apparatus for persons confined to a wheelchair as claimed in claim 1 wherein said ramp is provided with said locking means.

3. A swing apparatus for persons confined to a wheelchair as claimed in claim 1, wherein the ramp is provided with a biasing means which is configured so as to provide a biasing force which acts to reduce the weight load of the ramp thereby enabling a person to lift the ramp into engagement with the body of the swing more easily.

4. A swing apparatus for persons confined to a wheelchair as claimed in claim 1, wherein said body includes a retaining means for securing said wheelchair in position with respect to said body, said retaining means being mounted on a movable mounting so as to facilitate positioning of said mounting with respect to said wheelchair.

5. A swing apparatus for persons confined to a wheelchair as claimed in claim 4, wherein the seat members are adapted to clip together so as to provide a secure engagement of the two members when the seat is in its erected position.

6. A swing apparatus for persons confined to a wheelchair as claimed in claim 4 wherein said rear wall includes a generally upright surface which provides a back rest for the user.

7. A swing apparatus for persons confined to a wheelchair as claimed in claim 1, wherein the swing body is suspended from a frame structure for reciprocating motion by means of two pairs of substantially parallel arms which are pivotably mounted at first ends to mounting points on the frame structure and opposing ends of the arms are pivotally connected to mounting points on the swing body.

8. A swing apparatus for persons confined to a wheelchair as claimed in claim 1, wherein the seat assembly includes a pair of seat members, a first seat member being pivotably mounted to a platform of the body and a second seat member being privotably mounted to a rear wall of the body.

9. A swing apparatus for persons confined to a wheelchair as claimed in claim 8 wherein said rear wall is provided with anchor points for the installation of a seat belt so as to provide for restraining the user whilst the swing is in motion.

10. A swing apparatus for persons confined to a wheelchair as claimed in claim 1, wherein the body is of unitary construction.

11. A swing apparatus for persons confined to a wheelchair as claimed in claim 10, wherein the body of the swing is formed from moulded plastic.

12. A swing apparatus for persons confined to a wheelchair as claimed in claim 1, wherein the body includes vertically extending frame members.

13. A swing apparatus for persons confined to a wheelchair as claimed in claim 12, wherein said frame members take the form of steel rods.

14. A swing apparatus for persons confined to a wheelchair as claimed in claim 12, wherein said frame members are connected to mounting points on the swing body.

15. A swing apparatus for persons confined to a wheelchair as claimed in claim 12 further including transversely extending frame members which pass underneath the body and connect vertically extending frame members located on each side of the swing body.

* * * * *